US005678123A

United States Patent [19]

Kim

[11] Patent Number: 5,678,123

[45] Date of Patent: Oct. 14, 1997

[54] APPARATUS AND METHOD FOR ELIMINATING PAPER JAM IN IMAGE FORMING DEVICE

[75] Inventor: Young-Ju Kim, Suwon, Rep. of Korea

[73] Assignee: SamSung Electronics Co., Ltd., Kyungki-do, Rep. of Korea

[21] Appl. No.: 660,106

[22] Filed: Jun. 7, 1996

[30] Foreign Application Priority Data

Aug. 14, 1995 [KR] Rep. of Korea ..... 25001/1995

[51] Int. Cl.[6] ..... G03G 21/00

[52] U.S. Cl. ..... 399/21; 271/256

[58] Field of Search ..... 399/21, 22; 271/256, 271/259

[56] References Cited

U.S. PATENT DOCUMENTS 4,954,848 9/1990 Arima .
4,996,557 2/1991 Takagi .
5,034,771 7/1991 Makita .
5,081,508 1/1992 Kotani et al. .
5,117,261 5/1992 Sakai et al. .
5,459,553 10/1995 Kim .
5,461,460 10/1995 Lee .
5,479,240 12/1995 Lee et al. .
5,534,976 7/1996 Kim .

*Primary Examiner*—R. L. Moses
*Attorney, Agent, or Firm*—Robert E. Bushnell, Esq.

[57] ABSTRACT

An image forming device capable of detecting that a paper jam has occurred in a paper path thereof during a priming operation of the device, and when the paper jam has occurred, sets a time period for the user to manually eliminate the paper jam or eliminate the paper jam through an automatic process. Once the time period has elapsed and the paper jam has not been removed, an engine part of the device is automatically driven to rotate various rollers therein in an attempt to automatically deliver the jammed paper to an exterior of the device.

21 Claims, 3 Drawing Sheets

APPARATUS AND METHOD FOR ELIMINATING PAPER JAM IN IMAGE FORMING DEVICE

CROSS REFERENCE TO RELATED APPLICATIONS

This application makes reference to, incorporates the same herein, and claims all benefits accruing under 35 U.S.C. §119 from an application entitled *Method For Eliminating Paper Jam In Image Forming Apparatus* earlier filed in the Korean Industrial Property Office on 14 August 1995, which was duly assigned Ser. No. 25001/1995 by that Office.

BACKGROUND OF THE INVENTION

1. Field of the Invention

The present invention relates to an image forming device using an electrophotographic developing process, and particularly to an apparatus and method for automatically eliminating a paper jam in the image forming device.

2. Background of the Invention

An electrophotographic developing process is widely used in various types of image forming devices, such as printers, copiers, facsimile machines and other instruments, to generate an image corresponding to an electrical signal. Although electrophotographic developing processes have been instrumental in document production and reproduction, devices utilizing such processes are plagued by the occurrence of paper jams, i.e., an occurrence that paper is not normally fed through a paper path during image development, or not correctly discharged from the paper path.

A paper jam occurs under situations such as when a paper condition is poor, when paper is caught or slipped onto a specific portion of a paper path, or when any assembly on the paper path gets out of order. Additionally, the paper jammed in the device can be either a sheet of paper that is in poor condition or a sheet of paper that is in good condition, depending upon a paper state in the paper path. The poor paper condition indicates that very crumpled or torn paper exists on the paper path. Alternatively, the paper jam under the good paper condition indicates the existence of a situation where paper cannot be fed any longer due to equipment malfunction and block of power supply during the operation of the device.

Typically, when a paper jam occurs, the image forming device using the electrophotographic developing process automatically senses the paper jam, and then informs a user of its occurrence. Then, the user opens one or more access portals of the image forming device to access and eliminate the jammed paper.

As mentioned above, a previous effort to construct an image forming device that can automatically eliminate paper in the paper path, where the user does not physically eliminate the paper jam, is represented by U.S. Pat. No. 5,459,553 by Sung-Eun Kim and entitled *Method For Eliminating A Paper Jam In An Image Forming Apparatus* wherein determination of a paper jam causes a display of an indication of the paper jam, activates a paper jam elimination mode when a cover is open and closed by the user, and then the register rollers, fixing rollers and engine drive motor are driven to discharge the paper from the paper path.

Allowed U.S. application Ser. No. 08/202,971 by Kyung-Yeol Kim and entitled *Method For Eliminating A Paper Jam Of An Image Forming System And Apparatus Therefor* proposes to stop the engine drive motor upon detection of a paper jam, display an indication of the occurrence of the paper jam, and upon detection of the removal and reinsertion of a paper cassette, eliminate the paper jam by starting the engine drive motor and rotating the various rollers in the paper path.

In summary of the efforts of others earlier described herein, some of which are assigned to the same assignee as the present invention, when the paper jam has occurred, the user is required to interact with the image forming device in order to set the jam elimination mode. In response to the establishment of the jam elimination mode, the image forming device rotates various rollers of the engine part and photosensitive drum and ejects paper from the paper path to an exterior of the device to eliminate the paper jam. The jam elimination mode is set by opening or closing a cover of the device, detaching the paper cassette from the device, manually pressing a specific key on an operating panel of the primer, or switching the power supply off and then on again.

U.S. Pat. No. 5,461,460 by Bong-Gi Lee and entitled *Method For Eliminating A Paper Jam In An Image Forming Apparatus*, assigned to the same assignee as the present invention, discloses a scheme which does not require the user to interact with the device in order to initiate the paper jam elimination mode. The '460 patent uses two separate detection steps for detecting the occurrence of a paper jam. The determination of a paper jam in a first detection step activates a paper jam elimination mode and causes the heat fixing rollers to be heated, and an engine driving motor to be activated to eliminate the paper jam. When the first detection step does not detect a paper jam, the determination of a paper jam in a second detection step causes the engine driving motor to be activated to eliminate the paper jam without causing the fixing rollers to be heated because no toner is transferred to the paper.

I have determined, however, the these earlier described efforts are not capable of readily automatically eliminating a paper jam caused by paper having the above described poor condition, thus causing the engine drive motor and rollers to be continuously operated because the paper jam could not be eliminated.

Accordingly, I have determined that the paper jam eliminating method should have an additional operation in order to account for the paper jam being caused by paper in a poor condition, and for the possibility of the user having physically eliminated the paper jam of paper in the poor condition or automatically eliminated the paper jam of paper in a good condition.

SUMMARY OF THE INVENTION

It is therefore an object of the present invention to provide an improved image formation apparatus and process.

It is another object to provide an apparatus and process that allots the user time to eliminate a paper jam when the paper is in either a good condition state or a poor condition state, and is also able to automatically drive the engine driving motor to eliminate a paper jam caused by paper in a good condition state when the user does not eliminate the paper jam.

In order to achieve these and other objects, the present invention detects that a paper jam has occurred in a paper path of an image forming device during operation of the device and when the paper jam has occurred, sets a time period for the user to manually eliminate the paper jam or eliminate the paper jam through an automatic process, and once the time period has elapsed and the paper jam has not been removed, automatically driving an engine part of the device to rotate various rollers therein in an attempt to automatically deliver the jammed paper to an exterior of the device.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
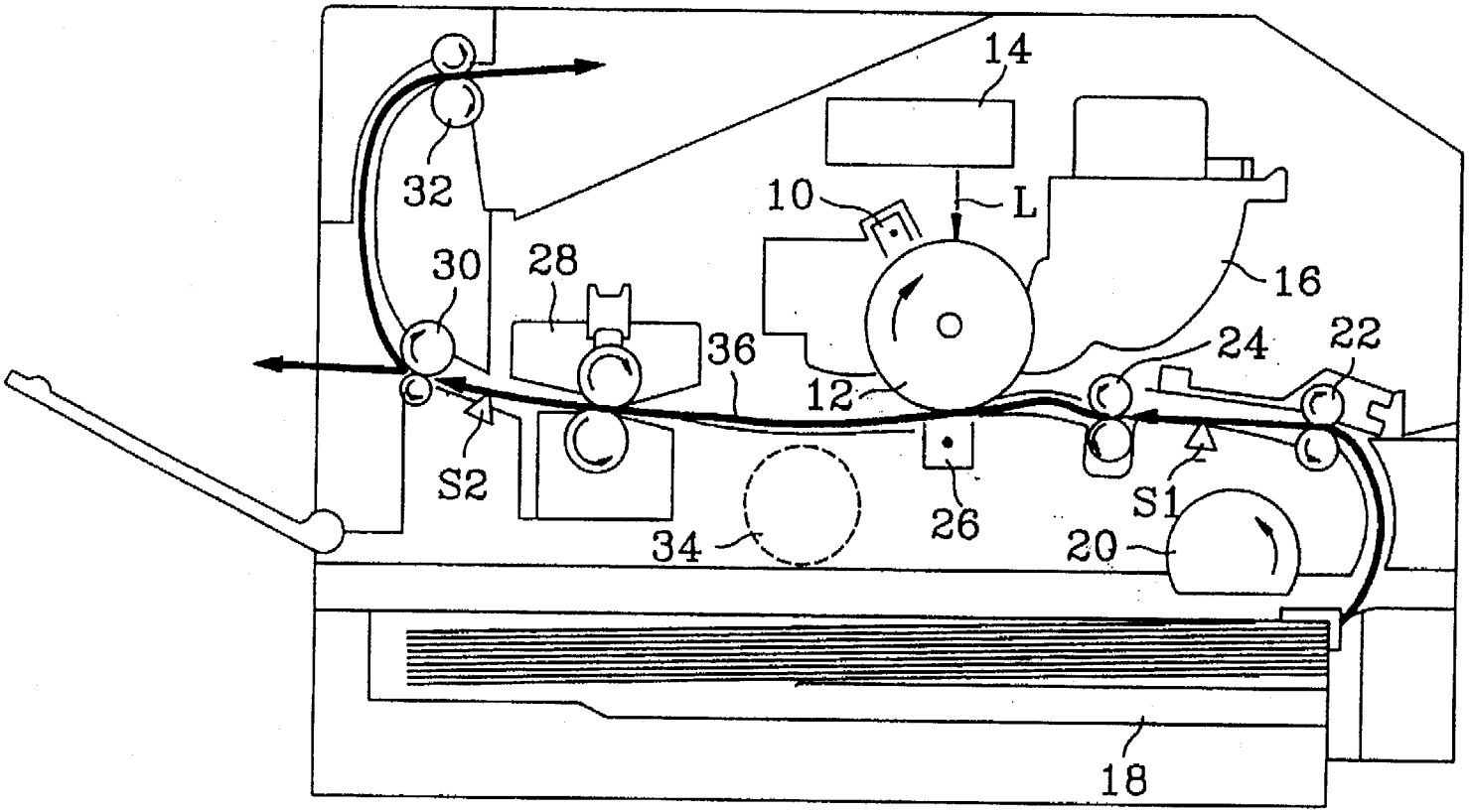
FIG. 1 is a construction view illustrating a mechanism of a laser beam printer in which the present invention is applied.

Turning now to the drawings, FIG. 1 depicts the mechanism of a laser beam printer, however, the present invention is not limited to the laser beam printer, and, as such, can be incorporated into other image forming devices such as a copier or a facsimile machine. The mechanism of the laser beam printer, as shown in FIG. 1, includes a charger 10 that forms a uniform charge on a photosensitive drum 12, a laser scanner unit 14 that generates a laser beam L corresponding to image data and exposes photosensitive drum 12, thereby forming an electrostatic latent image, and a developing unit 16 that transmits developing material such as toner to the electrostatic latent image formed on photosensitive drum 12. A pickup roller 20 picks up paper stacked in a paper cassette 18 and transmits the paper along paper path 36 to a conveyor roller 22 which conveys the paper picked up by the pickup roller 20 to a register roller 24. Register roller 24 transmits the paper to a transfer unit 26 which transfers the developing material formed on photosensitive drum 12 to the paper as photosensitive drum 12 rotates to transmit the paper to fixing rollers unit 28. Fixing rollers unit 28 subsequently fix the developing material to the paper by means of heat and pressure, and transmit the paper to delivery rollers 30 and 32 which, ultimately eject the image-formed paper to the exterior of the printer. An engine driving motor 34, generally depicted by dotted lines, is a main motor for driving each portion including the various rollers and photosensitive drum 12.

Also, sensors for determining the operational state of various portions of the printer and the conveyance state of paper are provided. FIG. 1 shows sensors S1 and S2 for detecting an occurrence of a paper jam. Sensor S1 is installed along paper path 36 between conveyor roller 22 and register roller 24, and sensor S2 is installed along paper path 36 between fixing rollers unit 28 and delivery roller 30. According to a preferred embodiment, sensors S 1 arid $2 each use a reflection type photo sensor.

Figure 2:
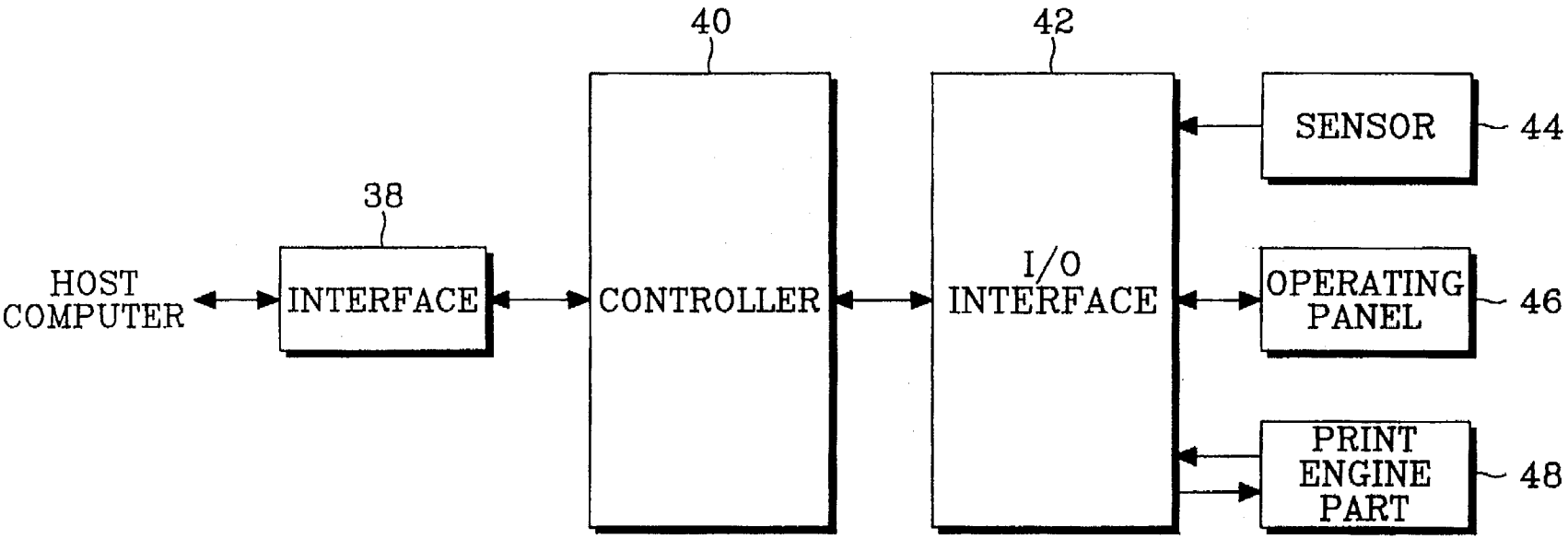
FIG. 2 is a circuit block construction view illustrating a laser beam printer control circuit incorporating the present invention.

FIG. 2 shows a block diagram of a control circuit for controlling at least a print engine of the printer of FIG. 1. An interface 38 interfaces a signal output by an external host computer (not shown) with the printer. A controller 40 communicates with the host computer through interface 38 and controls, via I/O (Input/Output) interface 42, a print engine part 48 in response to a received print command. Various commands for controlling the printer and print engine part 48 are input from the host computer and an operating panel 46 to perform various functions, such as a printing operation. I/O interface 42 interfaces controller 40 with operating panel 46, print engine part 48, and a sensor unit 44. Sensor unit 44 drives various sensors for detecting the operational state of each portion of the printer including sensors S1 and S2 which monitor the conveyance state of the paper through paper path 36, and then applies the output signal of each sensor to controller 40 through I/O interface Operating panel 46 has a plurality of keys (not shown) for inputting various commands and a displaying unit (not shown) for displaying information according to printer operations. Print engine part 48 includes engine drive motor 34 for conveying and printing the paper, and performs the printing operation under control of controller 40.

When a print command is applied to controller 40 from a host computer through interface 38 during a conventional standby mode, controller 40 initiates the printing operation. Here, the standby mode indicates a state in which the printer is ready to start a printing operation upon receipt of a print command. After the printer is initialized and performs a warm-up operation, the printer enters the standby state. Once a print command, followed by image data, is received, controller 40 operates pickup roller 20, conveyer roller 22, register roller 24, charger 10, photosensitive drum 12, laser scanner unit 14, developing unit 16, transfer unit 26, fixing rollers unit 28, and delivery rollers 30 or 32 by activating engine driving motor 34.

During the printing operation, controller 40 checks the states of sensors S1 and S2 through the sensor unit 44 and detects when a paper jam occurs in paper path 36 to thereby inform a user of its occurrence through the display on operating panel 46. Typically, after the pickup roller 20 is driven and paper is fed from the paper cassette 18, but the paper is not conveyed to sensor S1 within a first preset time, or the paper is not conveyed to sensor S2 within a second preset time, an indication of a paper jam is generated. Additionally, after paper is conveyed to sensor S2, but the paper is not ejected therefrom within a third preset time, an indication of a paper jam is generated. The preset times are determined according to times required to perform certain operations in each interval, i.e., the interval between paper cassette 18 and sensor S1, the interval between sensor S1 and sensor S2, and the interval between sensor S2 and the outside of the printer, of paper path 36.

When an indication of a paper jam is generated as discussed above, the state of the paper jammed in the paper path can be one of a poor paper condition and a good paper condition as discussed earlier.

The present invention is subjected to automatically eliminate the paper jam without making the user to have an additional operation when the paper state has a good paper condition. However, when the paper state has a poor paper condition, the user will have to attempt to remove the paper jam.

Figure 3:
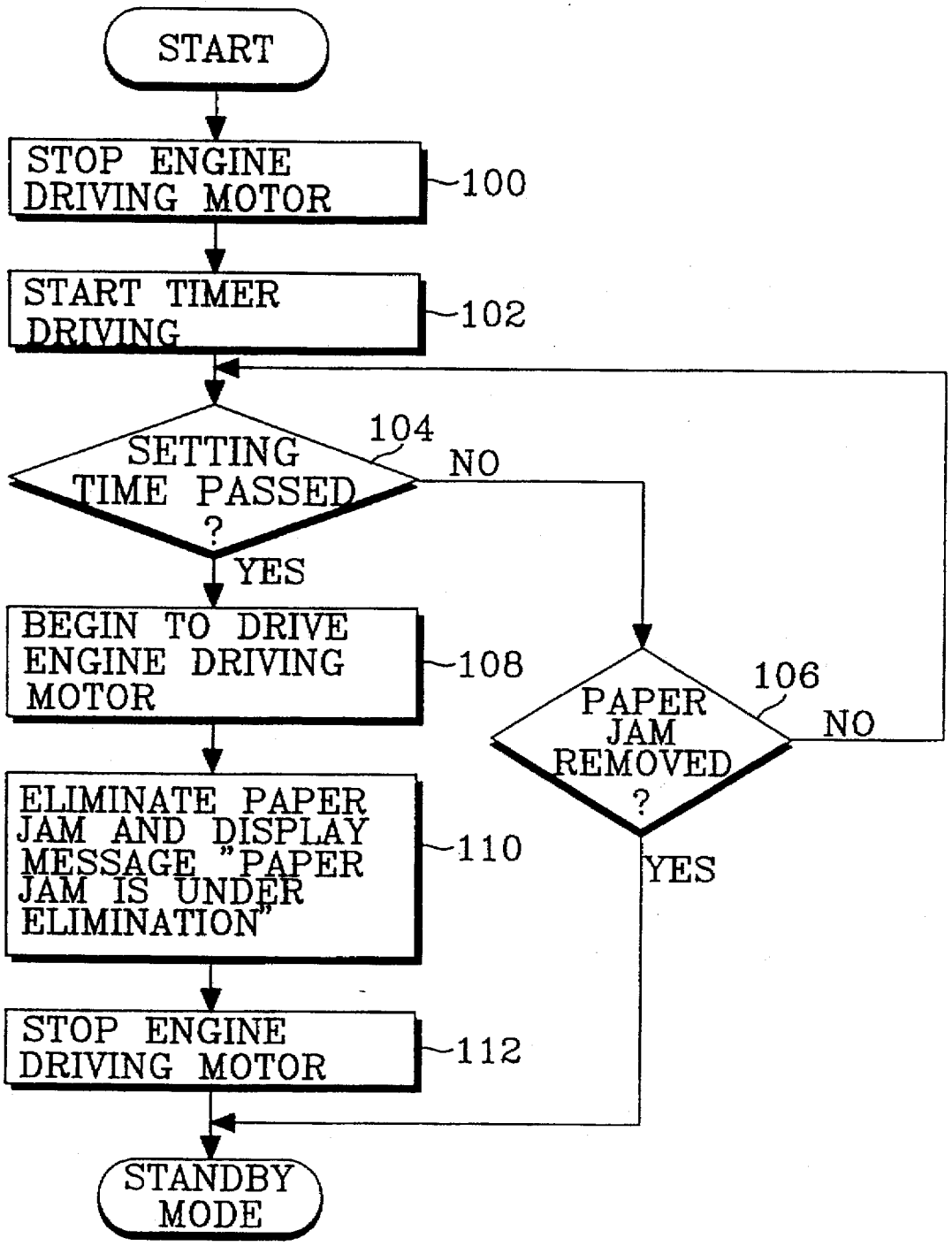
FIG. 3 is a flow chart illustrating a paper jam eliminating process performed according to the principles of the present invention.

Referring now to FIG. 3, the paper jam eliminating operation for an image forming device and implemented according to the principles of the present invention will be explained in detail hereinafter. When a paper jam occurs, controller 40 terminates operation of e engine driving motor 34 and stops the printing operation at step 100. Thereafter, controller 40, at step 102, begins to drive an internal timer and, at step 104, checks to determine whether a predetermined time period has elapsed.

When it is determined that the predetermined time period has not elapsed, step 104, controller 40 determines in step 106 whether the paper jam has been removed. Steps 104 and 106 are repeated until the predetermined time period has elapsed or until the paper jam has been removed. When the paper jam has been removed within the predetermined time period, controller 40 sets the image forming device into the standby state discussed previously. During the above mentioned predetermined time period, the user can automatically or manually eliminate the paper jam.

To automatically eliminate the paper jam, the paper in paper path 36 must be in a good condition state, and will be ejected to the exterior of the image forming device by the driving of the engine driving motor 34 according to an initialing mode or a jam elimination mode established by the user, such as by opening and closing of an access portal, by removing and reinserting paper cassette 18 or, preferably, by activation of one of the keys (not shown) on operating panel 46.

When the paper is in a poor condition state, the user's attempt to automatically eliminate the paper jam will fail. Accordingly, the user must physically eliminate the paper jam, however, the user could decide to physically eliminate the paper jam and make no attempt to automatically eliminate the paper jam. To manually eliminate the paper jam,the user opens the access portal (cover or door) of the image forming device, and manually removes the paper jam from paper path 36.

When the paper jammed state is removed, step 106, within the preset time, the standby mode begins. However, when the paper jammed state is not removed within the preset time, steps 104 and 106, controller 40 automatically activates engine driving motor 34 and each portion of the printer engine part 48, step 108, thereby enabling rotation of pickup roller 20, convey roller 22, register roller 24, photosensitive drum 12, fixing rollers unit 28 and discharge rollers 30 or 32. Simultaneously, a message informing the user that the paper jam is under elimination is displayed, step 110, on operating panel 46. Accordingly, paper in a good condition state in the paper path 36 is delivered to the exterior of the printer, and the paper jam is eliminated. Thereafter, in step 112, controller 40 terminates operation of the engine driving motor 34 and again proceeds to the standby mode. Here it should be understood that when the paper jam is not eliminated by steps 108–112 within a predetermined time, the standby mode is entered, and any attempt to perform a print operation will result in a repeat of a paper jam condition and a return to step 100.

From the aforementioned above, the present invention is capable of automatically eliminating a paper jam without making the user physically remove the jammed paper when the paper is in a good condition state.

In the meantime, although the detailed embodiment of the present invention is described therein, various modifications can be implemented within the spirit and the scope of the present invention. For example, step 112 can be followed by a step which checks whether the paper jam has been removed (see step 106) wherein a negative result will return the process to step 108 and a positive result will result in the image forming device being put in the standby mode. Additionally, the disclosed embodiment of the present invention is applied to a situation where a paper jam is automatically eliminated when the user does not attempt to remove the paper jammed state within the preset time. However, it is also appreciated that the present invention may also be applied to a situation where elimination of the paper jam is automatically started, i.e., steps 108–112 would follow step 102 on receiving the generated indication of the paper jam and steps 104 and 106 would follow step 112. Further, the present invention is intended to display a message to inform that the paper jam is under elimination, but it is also possible to omit this operation. Furthermore, although the disclosed embodiment of the present invention is applied to a laser beam printer (LBP), it is possible to apply the present invention to a copier, light a emitting diode printer head (LPH) printer, a facsimile or other device using an electrophotographic developing process. Accordingly, the scope of the present invention is not defined solely by the disclosed embodiment, but rather by the scope of the appended claims and the equivalent thereof.

What is claimed is:

1. A method for eliminating a paper jam occurring during a print operation in an image forming device, said method comprising the steps of:

detecting a paper jam in a paper path of said device during a print operation for an electrophotographic developing process comprised of rotation of an engine driving motor in an image forming device;

stopping rotation of said engine driving motor;

setting a time period by starting a timer;

determining when said time period has elapsed; and eliminating said paper jam by delivering paper from said paper path to an exterior part of said device by automatically starting said engine driving motor, when said time period has elapsed.

2. The method as set forth in claim 1, further comprising a step of displaying a message to inform a user that said paper jam is under an elimination process during said step of eliminating said paper jam by delivering paper from said paper path to an exterior part of said device.

3. The method as set forth in claim 1, further comprising the steps of:

stopping said engine drive motor when said paper jam is eliminated; and setting print operation of said device into a standby mode.

4. The method as set forth in claim 1, further comprising the steps of:

stopping said engine drive motor when said paper jam is eliminated; and putting said device in a standby mode.

5. The method as set forth in claim 1, further comprising the steps of:

determining whether said paper jam was removed by a user during said time period; and returning to said step of determining when said time period has elapsed when it is determined that said paper jam has not been removed during said time period.

6. The method as set forth in claim 5, further comprising a step of putting said device in a standby mode when said paper jam is determined to have been removed by said user during said time period.

7. A method for eliminating a paper jam from an image forming device using an electrophotographic developing process, said method comprising the steps of:

detecting when a paper jam has occurred in a paper path of said device during a print operation;

checking whether said paper jam is removed by a user during a preset time, when said paper jam is detected;

setting said device in a standby mode when said paper jam is removed during said preset time; and driving an engine part of said device to automatically eliminate said paper jam by delivering paper in said paper path to an exterior part of said device.

8. The method as set forth in claim 7, further comprising a step of displaying a message to inform said user that said paper jam is under an automatic elimination process during said step of driving said engine part of said device to automatically eliminate said paper jam.

9. The method as set forth in claim 8, further comprising the steps of:

stopping said engine part when said paper jam is eliminated; and putting said device in said standby mode.

10. The method as set forth in claim 7, further comprising a step of:

removing said paper jam during said preset time by said user physically removing a jammed paper from said paper path.

11. The method as set forth in claim 7, further comprising a step of:

removing said paper jam during said preset time by said user activating said engine part to deliver a jammed paper in said paper path to said exterior part of said device.

12. The method as set forth in claim 11, further comprising a step of:

removing said paper jam during said preset time by said user physically removing a jammed paper from said paper path, when said user's activation of said engine part fails to deliver said jammed paper in said paper path to said exterior part of said device.

13. An apparatus for detecting an occurrence of a paper jam and for eliminating a paper from a paper path of an image forming device when said paper is in a jammed state, said apparatus comprising:

sensing means for monitoring said paper path by detecting said paper when said paper is fed through said paper path during a print operation;

controller means for detecting said occurrence of said paper jam by checking a state of said sensing means;

said controller means stopping an engine driving motor when said occurrence of said paper jam is detected;

said controller means checking whether a user has eliminated said paper jam within a preset time period;

said controller means starting said engine driving motor to automatically eliminate said paper jam by delivering said paper in said paper path to an exterior pan of said image forming device and then stopping said engine driving motor when said paper has been delivered to said exterior pan of said image forming device; and said controller means setting said image forming device in a standby mode when said paper jam has been eliminated.

14. The apparatus as set forth in claim 13, said sensing means comprising a first sensor disposed along a first portion of said paper path and a second sensor disposed along a second portion of said paper path.

15. The apparatus as set forth in claim 14, said controller means detecting said paper jam when said first sensor paper fails to detect said paper within a predetermined time period.

16. The apparatus as set forth in claim 14, said controller means detecting said paper jam when said second sensor paper fails to detect said paper with in a predetermined time period after said paper was detected by said first sensor.

17. The apparatus as set forth in claim 14, said controller means detecting said paper jam when said first sensor continues to detect said paper for a predetermined time period after said paper has been detected by said second sensor.

18. The apparatus as set forth in claim 14, said controller means detecting said paper jam when said second sensor continues to detect said paper for a predetermined time period after said paper was originally detected by said second sensor.

19. The apparatus as set forth in claim 13, said controller means controlling a display on an operating panel to display a message indicating that said paper jam is under an automatic elimination process simultaneously with said starting of said engine driving motor.

20. The apparatus as set forth in claim 13, said image forming device comprising:

pickup roller means initially feeding said paper from a paper cassette into said paper path;

conveyor roller means receiving said paper from said pickup roller means and feeding said paper further along said paper path;

register roller means receiving said paper from said conveyor roller means and feeding said paper to a photosensitive drum;

said photosensitive drum feeding said paper to fixing roller means; and delivery roller means receiving said paper from said fixing roller means and delivering said paper to said exterior part of said image forming device;

said pickup roller means, conveyor roller means, register roller means, photosensitive drum, fixing roller means and delivery roller means being rotated in response to said engine driving means being started by said controller means.

21. The apparatus as set forth in claim 14, said image forming device comprising:

pickup roller means initially feeding said paper from a paper cassette into said paper path;

conveyor roller means receiving said paper from said pickup roller means and feeding said paper further along said paper path;

register roller means receiving said paper from said conveyor roller means and feeding said paper to a photosensitive drum, said first sensor being positioned between said conveyor roller means and said register roller means;

said photosensitive drum feeding said paper to fixing roller means; and delivery roller means receiving said paper from said fixing roller means and delivering said paper to said exterior part of said image forming device, said second sensor being positioned between said fixing roller means and said delivery roller means;

said pickup roller means, conveyor roller means, register roller means, photosensitive drum, fixing roller means and delivery roller means being rotated in response to said engine driving means being started by said controller means.

* * * * *